US012201209B2

(12) United States Patent
Zhang

(10) Patent No.: US 12,201,209 B2
(45) Date of Patent: Jan. 21, 2025

(54) DUAL-PURPOSE STAND FOR HAMMOCK AND HANGING CHAIR

(71) Applicant: NINGBO MINGHUANG HOME FURNISHING PRODUCTS CO.,LTD, Ningbo (CN)

(72) Inventor: Yuese Zhang, Ningbo (CN)

(73) Assignee: NINGBO MINGHUANG HOME FURNISHING PRODUCTS CO., LTD., Ningbo (CN)

( * ) Notice: Subject to any disclaimer, the term of this patent is extended or adjusted under 35 U.S.C. 154(b) by 306 days.

(21) Appl. No.: 17/749,342

(22) Filed: May 20, 2022

(65) Prior Publication Data

US 2022/0312945 A1 Oct. 6, 2022

(30) Foreign Application Priority Data

Apr. 29, 2022 (CN) ..... 202221022425.9

(51) Int. Cl.
*A45F 3/24* (2006.01)
*A45F 3/26* (2006.01)
*A47C 3/025* (2006.01)

(52) U.S. Cl.
CPC ..... *A45F 3/24* (2013.01); *A45F 3/26* (2013.01); *A47C 3/0255* (2013.01)

(58) Field of Classification Search
CPC . A47C 3/0255; A45F 3/24; A45F 3/26; A45F 3/22
See application file for complete search history.

(56) References Cited

U.S. PATENT DOCUMENTS

| | | | | |
|---|---|---|---|---|
| 5,113,538 | A * | 5/1992 | Branch, III | A45F 3/24 5/120 |
| 5,297,302 | A * | 3/1994 | Anderson | A45F 3/24 403/174 |
| 5,729,845 | A * | 3/1998 | Hsu | A45F 3/24 5/120 |
| 6,711,764 | B1 * | 3/2004 | Mauze, Jr. | A45F 3/24 5/120 |
| 6,931,679 | B1 * | 8/2005 | Tseng | A61K 31/513 5/127 |
| D688,062 | S * | 8/2013 | Dao | D6/387 |
| 11,388,977 | B2 * | 7/2022 | Gibson | A45F 3/24 |
| D964,080 | S * | 9/2022 | Tsanev | D6/718.11 |
| D993,701 | S * | 8/2023 | Zhu | D6/718.12 |
| D1,001,530 | S * | 10/2023 | Dong | D6/718.12 |
| 11,871,836 | B2 * | 1/2024 | Kayyal | A45F 3/24 |
| 2005/0210582 | A1 * | 9/2005 | Branch, III | A45F 3/24 5/127 |

(Continued)

FOREIGN PATENT DOCUMENTS

CN 201585599 U 9/2010

*Primary Examiner* — Justin C Mikowski
*Assistant Examiner* — Morgan J McClure

(57) ABSTRACT

A dual-purpose stand for hammock and hammock chair, including at least one support assembly. The at least one support assembly each comprises a bottom rod. Two ends of the bottom rod are each provided with a suspension frame. The at least one support assembly is each provided with a bending portion. The bending portion is configured to be turned to adjust a spacing between suspension points of suspension frames, so as to correspondingly form a hammock suspension form or a hammock chair suspension form.

10 Claims, 13 Drawing Sheets

(56) References Cited

U.S. PATENT DOCUMENTS

| | | | | |
|---|---|---|---|---|
| 2005/0262631 | A1* | 12/2005 | Clark | A45F 3/24 5/127 |
| 2016/0088922 | A1* | 3/2016 | Frankson | A45F 3/24 5/129 |
| 2019/0075915 | A1* | 3/2019 | Wilke | A45F 3/24 |
| 2019/0090618 | A1* | 3/2019 | McDermott | A45F 3/26 |
| 2019/0365085 | A1* | 12/2019 | Goodwin | A45F 3/24 |
| 2021/0244162 | A1* | 8/2021 | McDermott | A47C 27/081 |
| 2022/0273090 | A1* | 9/2022 | Zhang | A45F 3/24 |

* cited by examiner

DUAL-PURPOSE STAND FOR HAMMOCK AND HANGING CHAIR

CROSS-REFERENCE TO RELATED APPLICATIONS

This application claims the benefit of priority from Chinese Patent Application No. 202221022425.9, filed on Apr. 29, 2022. The content of the aforementioned application, including any intervening amendments thereto, is incorporated herein by reference in its entirety.

TECHNICAL FIELD

This application relates to hammock stand manufacturing, and more particularly to a dual-purpose stand for hammock and hammock chair.

BACKGROUND

With the improvements of people's living standards, outdoor activities have become increasingly popular, and a readily-portable hammock and hammock chair are preferred. Even though both of the hammock and the hammock chair have similar integrated structures and require stands to provide suspension points, the stands commercially available on the market often fails to satisfy the suspension requirements of both of the hammock and the hammock chair due to the different spacing between suspension points of suspension frames of the hammock and the hammock chair at the same time.

Chinese patent application No. 200920279717.9, titled "hammock stand" discloses a hammock stand, including two suspension units, two support assemblies and two positioning assemblies. The two suspension units are configured to suspend the hammock. The two support assemblies are foldable. One side of the two support assemblies is pivotally provided on one of the two suspension units, and the other side of the two support assemblies is pivotally provided on the other of the two suspension units. Two positioning assemblies are provided on two sides of the two support assemblies, are connected to the support assemblies respectively to adjust an included angle formed by the two support assemblies. The suspension units are pivotally connected to the support assemblies, and in fit with the positioning assemblies to allow the hammock stand to adjust the included angle formed by the two support assemblies. Unfortunately, such structure is complex, and the adjustment range of the included angle is limited, and thus the structure requires to be further optimized to meet the suspension requirements of the hammock chairs.

SUMMARY

An objective of this disclosure is to provide a dual-purpose stand for hammock and hammock chair with simple structure, convenient use and simple and fast transformation to overcome the above-mentioned defects in the existing stands for hammock and hammock chair.

Technical solutions of this application are described as follows.

This application provides a dual-purpose stand for hammock and hammock chair, comprising:

at least one support assembly;

wherein the at least one support assembly each comprises a bottom rod; two ends of the bottom rod are each provided with a suspension frame; the at least one support assembly is each provided with a bending portion; and the bending portion is configured to be turned to adjust a spacing between suspension points of suspension frames, so as to correspondingly form a hammock suspension form or a hammock chair suspension form.

In an embodiment, the bending portion is provided on the suspension frame. The suspension frame can adopt an integrated structure, or a combined structure composed of several components for packaging and transportation.

In an embodiment, the number of the at least one support assembly is one; the bottom rod comprises a base rod and connecting parts respectively connected to two ends of the base rod; and each of the connecting parts is provided with a base; and the connecting parts are in extendable-retractable fit with the base rod. The base is configured to form a stable structure. The connecting part is in extendable-retractable fit with the base rod to adjust the spacing between suspension points.

In an embodiment, the number of the at least one support assembly is one; the bottom rod comprises a base rod, an extension rod and two connecting parts; the base rod is in detachable fit with the extension rod; the two connecting parts are connected to the base rod or the extension rod; and the two connecting parts are each fixedly provided with a base. The base is configured to form a stable structure. The spacing between the suspension points is adjusted by whether the extension rod is connected or not.

In an embodiment, the number of the at least one support assembly is two; two support assemblies are configured to support each other to form a stable structure; the bottom rod comprises a base rod; two ends of the base rod are each connected to a connecting part; the connecting part is in extendable-retractable fit with the base rod; a lower part of the suspension frame is connected to the connecting part; and upper parts of suspension frames are connected to each other at the same side. The base rods are arranged in parallel, and cooperate with the suspension frames, and each part is connected to form a end-to-end circular structure, so as to form the stable structure.

In an embodiment, the suspension frame has an arc structure.

In an embodiment, the two ends of the bottom rod are each provided with the bending portion. The bending portion is provided on the bottom rod, and is configured to transform between the hammock suspension form and the hammock chair suspension form. The bottom rod can adopt an integrated structure, or a combined structure composed of several components for packaging and transportation.

In an embodiment, the number of the at least one support assembly is one; the bottom rod comprises a base rod; two ends of the base rod are each connected to a connecting part; the bending portion is provided on the connecting part; the connecting part is in extendable-retractable fit with the base rod; and a bottom of the suspension frame is provided with a base.

In an embodiment, the number of the at least one support assembly is two; two support assemblies are configured to support each other to form a stable structure; the bottom rod comprises a base rod; two ends of the base rod are each connected to a connecting part; the bending portion is provided on the connecting part; the connecting part is in extendable-retractable fit with the base rod; a lower part of the suspension frame is connected to the connecting part; and upper parts of suspension frames are connected to each other at the same side.

In an embodiment, each connection on the dual-purpose stand is in plug-in fit which is simple structure and convenient installation.

Compared with the prior art, this application has the following beneficial effects.

The dual-purpose stand for hammock and hammock chair provided herein has the advantages of simple structure and convenient manufacturing. The bending portion is configured to be turned (into two installation modes) to form two extension directions, thereby correspondingly forming two suspension forms with different spacing between the suspension points of the suspension frames, such that the suspension requirements of the hammock or the hammock chair are satisfied. The transformation between two different suspension forms is realized by merely changing the connection position of the bending portion, which is simple, fast and easy to operate.

Figure 1:
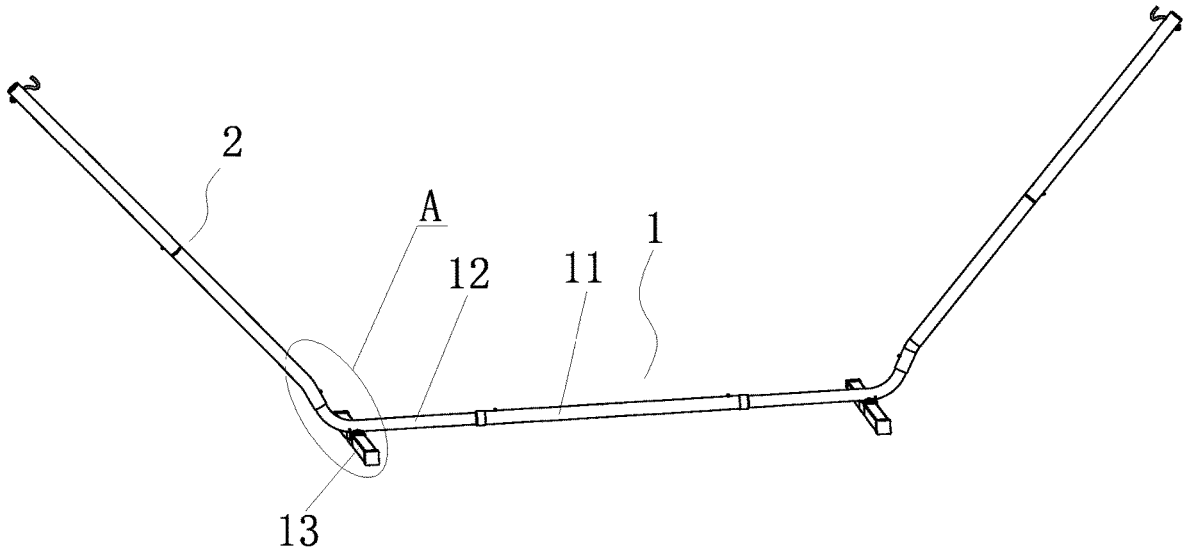
FIG. 1 schematically shows a spatial structure of a stand according to Embodiment 1 of this disclosure when used for suspending a hammock.
Figure 2:
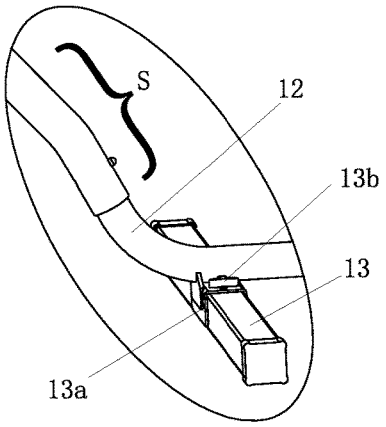
FIG. 2 is an enlarged view of part Ain FIG. 1.

In the drawings, S, bending portion; 1, bottom rod; 11, base rod; 12, connecting part; 13, base; 13*a*, mounting seat; 13*b*, locking member; 13*c*, connecting rod; 13*d*, first support rod; 14, extension rod; 2, suspension frame; 21, second support rod; and 22: fixed rod.

DETAILED DESCRIPTION OF EMBODIMENTS

This application will be described in detail below with reference to the accompanying drawings and embodiments.

A dual-purpose stand for hammock and hammock chair is provided, including at least one support assembly. The at least one support assembly each comprises a bottom rod 1. Two ends of the bottom rod 1 are each provided with a suspension frame 2. The at least one support assembly is each provided with a bending portion (S). The bending portion (S) is configured to be turned to adjust a spacing between suspension points of suspension frames, so as to correspondingly form a hammock suspension form or a hammock chair suspension form.

The bending portion (S) is provided on the suspension frame 2 or the bottom rod 1. The suspension frame 2 can have an integrated structure or a combined structure composed of several components for packaging and transportation, where the bending portion (S) is provided on one of the components. In the same way, the bottom rod 1 can have an integrated structure or a combined structure composed of several components for packaging and transportation. The combined structure enables to shorten a length of each component, facilitating packaging and transportation.

The bending portion (S) is configured to be arranged at a lower part of the suspension frame 2 or at an upper part of the suspension frame 2. The bending portion (S) can have a curved structure or broken-line structure. As transformation, the suspension frame 2 is provided with a branched structure, such that the suspension point deviates from an axis of the suspension frame 2, and a bending part formed by the branch and the suspension frame is also regarded as a bending portion (S).

Each connection on the dual-purpose stand is in plug-in fit, and is fixed by the cooperation of a insertion pin and a pin hole. Each connection is also configured to be in clamping fit.

The bending portion (S) is configured to allow an end of the bending portion (S) away from the connection deviates from an axis of the connection.

This application will be described in detail below with reference to the following embodiments.

Embodiment 1

Referring to an embodiment shown in FIGS. 1-4, a dual-purpose stand for hammock and hammock chair is provided, including one support assembly. The support assembly comprises a bottom rod 1. Two ends of the bottom rod 1 are each provided with a suspension frame 2. A bending portion (S) is provided at a lower part of the suspension frame 2. The suspension frame 2 adopts a two-section connection structure. The bottom rod 1 includes a base rod 11. Two ends of the base rod 11 are each provided with a connecting part 12. A base 13 is provided on the connecting part 12. The connecting part 12 is in extendable-retractable fit with the base rod 11.

Two pin holes are provided on the suspension frame 2 at one end close to the bottom rod 1, and the two pin holes are arranged on the same cross-section. The included angle between the two pin holes is 180°. The component (i.e., the lower part of the suspension frame 2) where the bending portion (S) is located is configured to be adjusted by switching the installation mode to change an extension direction of the upper part of the suspension frame 2, so as to change an inclination angle of the suspension frame 2 after being installed, thereby changing the spacing between the suspension points between the suspension frames.

The suspension frame 2 adopts a two-section assembly structure, shortening a length of a single component and reducing the packaging and transportation cost. The base 13 is in detachable fit with the connecting part 12. The base 13 is made of a hollow square tube. Two ends of the base 13 are each provided with a protective cover, which can not only prevent sundries from entering the base 13, but also prevent the user from being scratched by the end edges of the base 13, making it safer in use. The connecting part 12 is fixedly provided with a mounting seat 13*a*, having a square structure with one edge open. The opening of the mounting seat 13*a* faces down. When installing, the base 13 is inserted into the mounting seat 13*a*, and locked with a locking member 13*b*, facilitating the assembly and disassembly. Considering that the base 13 has a square cross-section, the placement is more stable.

The connecting part 12 is in extendable-retractable fit with the base rod 11. The connecting part 12 is provided with a extendable-retractable insertion pin. Two ends of the base rod 11 are respectively symmetrically provided with a pin hole, and a middle portion of the base rod 11 is symmetrically provided with two pin holes. The insertion pin is configured to be in fit with different pin holes to adjust an insertion depth of the connecting parts 12 to adjust a length of the bottom rod 1, so as to adjust the spacing between suspension points of suspension frames.

Figure 3:
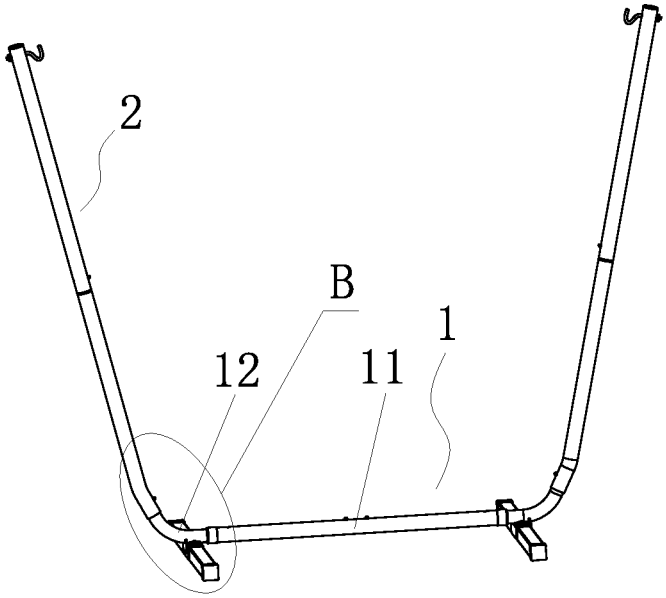
FIG. 3 schematically shows a spatial structure of the stand according to Embodiment 1 of this disclosure when used for suspending a hammock chair.
Figure 4:
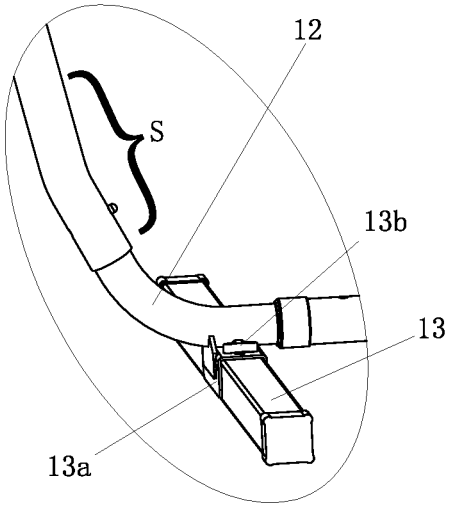
FIG. 4 is an enlarged view of part B in FIG. 3.

In this embodiment, the bending portion (S) has an obtuse-angle structure. As shown in FIG. 1, when the hammock is suspended, the cooperation between the connecting parts 12 at both ends and the base rod 11 is in an elongated state. The suspension frame 2 is extended outward using the obtuse-angle structure (A center line of a connecting portion where a lower end of the suspension frame 2 is connected to the connecting part 12 is taken as a reference.). At this time, an included angle between the suspension frames 2 on both sides is relatively large, that is, a spacing between the suspension points of the suspension frames 2 on both sides is relatively large, which is suitable for suspending a hammock. As shown in FIG. 3, when the hammock chair is suspended, the cooperation between the connecting parts 12 at both ends and the base rod 11 is in a shortened state. The suspension frame 2 is retracted inward using an obtuse-angle structure (A center line of a connecting portion where a lower end of the suspension frame 2 is connected to the connecting part 12 is taken as a reference.) At this time, an included angle between the suspension frames 2 on both sides is relatively small, that is, the spacing between the suspension points of the suspension frames 2 on both sides is relatively small, which is suitable for suspending a hammock chair. By comparing the two suspension forms shown in FIGS. 1 and 3, it can be found that the included angle between the two suspension frames 2 can be in one support assembly, adjusted by switching the installation mode (the azimuth difference between the two installation modes is 180°) of the component where the bending portion (S) is located, so as to conveniently adjust the spacing between suspension points of suspension frames to meet the suspension requirements of the hammock and the hammock chair by one support assembly.

Embodiment 2

Figure 5:
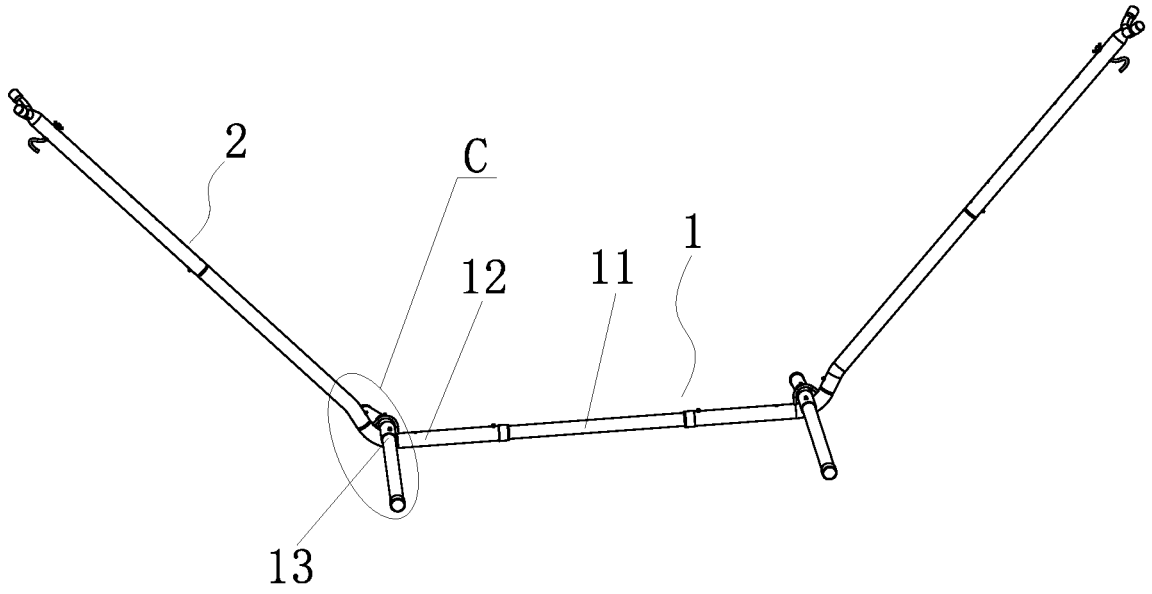
FIG. 5 schematically shows a spatial structure of a stand according to Embodiment 2 of this disclosure when used for suspending a hammock.
Figure 6:
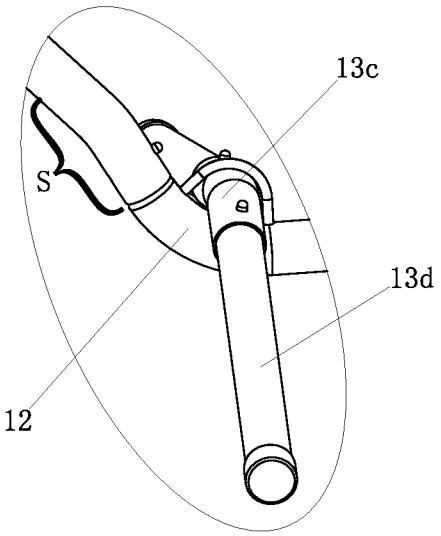
FIG. 6 is an enlarged view of part C in FIG. 5.
Figure 7:
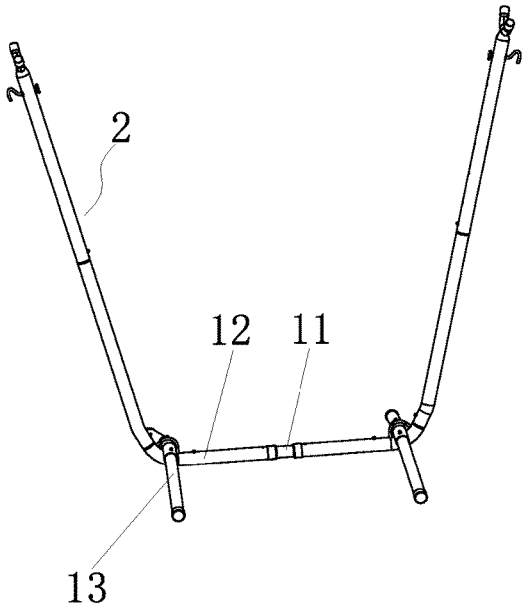
FIG. 7 schematically shows a spatial structure of the stand according to Embodiment 2 of this disclosure when used for suspending a hammock chair.

Referring to FIGS. 5-7, a dual-purpose stand provided in Embodiment 2 is basically the same as the dual-purpose stand provided in Embodiment 1, except for the structure of the base 13. In this embodiment, the base 13 includes a connecting rod 13*c* and a first support rod 13*d*. Each connecting part 12 is fixedly provided with a connecting rod 13*c*. Two ends of the connecting rod 13*c* are each connected to a first support rod 13*d*, where the first support rod 13*d* is detachable. The first support rod 13*d* is connected to the connecting rod 13*c* to form a stable support structure.

In this embodiment, the connecting part 12 is in extendable-retractable fit with the base rod 11. The insertion pin is provided on the base rod 11, and the pin hole is provided on the connecting part 12. When connected, the connecting part 12 is sleevedly provided outside the base rod 11. The bending portion (S) has an obtuse-angle structure.

As shown in FIG. 5, when the hammock is suspended, the cooperation between the connecting parts 12 at both ends and the base rod 11 is in an elongated state. The suspension frame 2 is extended outward using the obtuse-angle structure (A center line of a connecting portion where a lower end of the suspension frame 2 is connected to the connecting part 12 is taken as a reference.) At this time, the included angle between the suspension frames 2 on both sides is large, that is, the spacing between the suspension points of the suspension frames 2 on both sides is large, which is suitable for suspending a hammock. As shown in FIG. 7, when the hammock chair is suspended, the cooperation between the connecting parts 12 at both ends and the base rod 11 is in a shortened state, and the suspension frame 2 is retracted inward using the obtuse-angle structure (A center line of a connecting portion where a lower end of the suspension frame 2 is connected to the connecting part 12 is taken as a reference.) At this time, the included angle between the suspension frames 2 on both sides is relatively small, that is, the spacing between the suspension points of the suspension frames 2 on both sides is relatively small, which is suitable for suspending the hammock chair.

Embodiment 3

Figure 8:
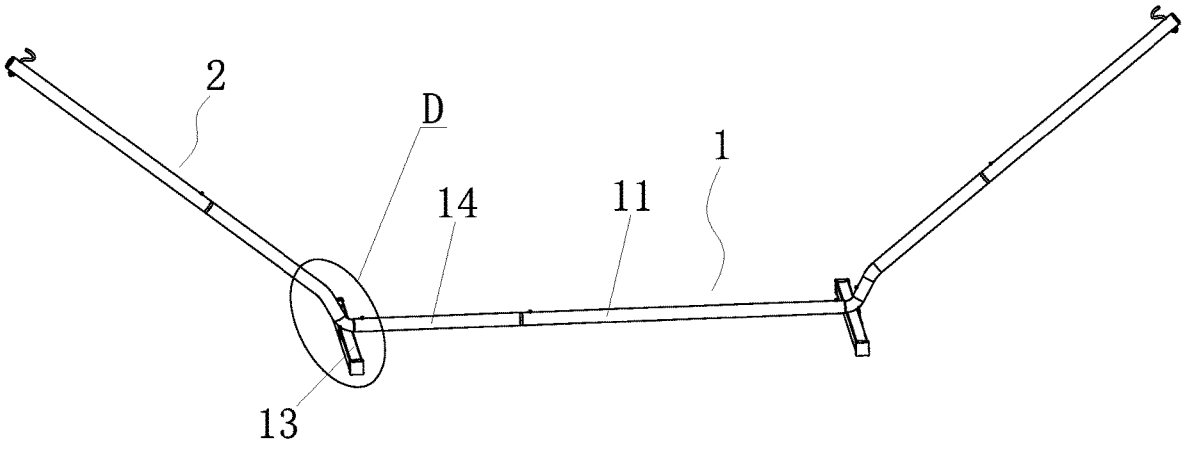
FIG. 8 schematically shows a spatial structure of a stand according to Embodiment 3 of this disclosure when used for suspending a hammock.
Figure 9:
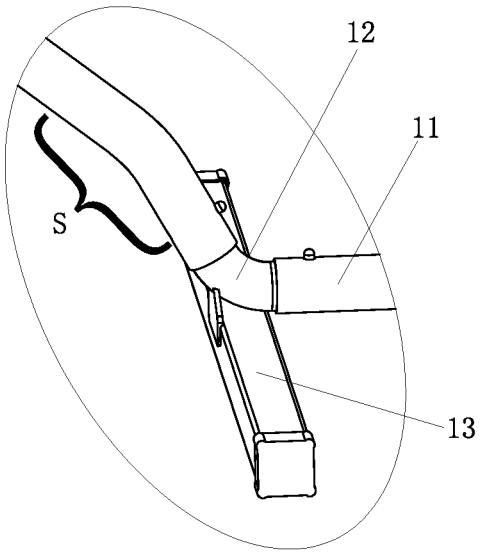
FIG. 9 is an enlarged view of part D in FIG. 8.
Figure 10:
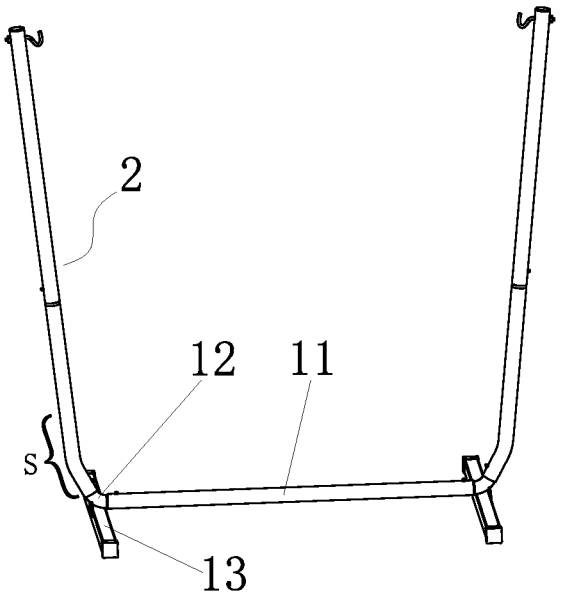
FIG. 10 schematically shows a spatial structure of the stand according to Embodiment 3 of this disclosure when used for suspending a hammock chair.

Referring to FIGS. 8-10, a dual-purpose stand provided in Embodiment 3 includes one support assembly, and the dual-purpose stand structure provided in Embodiment 3 is basically the same as that in Embodiment 1, except that the bottom rod 1 includes a base rod 11, an extension rod 14 and two connecting parts 12. The base rod 11 is in detachable fit with the extension rod 14. The two connecting parts 12 are connected to the base rod 11 or the extension rod 14. The two connecting parts 12 are each provided with a base 13.

In this embodiment, the spacing between suspension points of suspension frames is adjusted by whether the extension rod 14 is connected or not. As shown in FIG. 8, when the hammock is suspended, the extension rod 14 is connected to one end of the base rod 11 to further increase the spacing between suspension points of suspension frames. One of the two connecting parts 12 is connected to the base rod 11, the other of the two connecting parts 12 is connected to the extension rod 14. As shown in FIG. 10, when the hammock chair is suspended, the extension rod 14 is disassembled, and two ends of the base rod 11 are each connected to one of the two connecting parts 12. The transformation between the hammock suspension form and the hammock chair suspension form is the same as that in Embodiment 1, which is easy to be realized by switching the installation mode of the component where the bending portion (S) is located.

Embodiment 4

Figure 11:
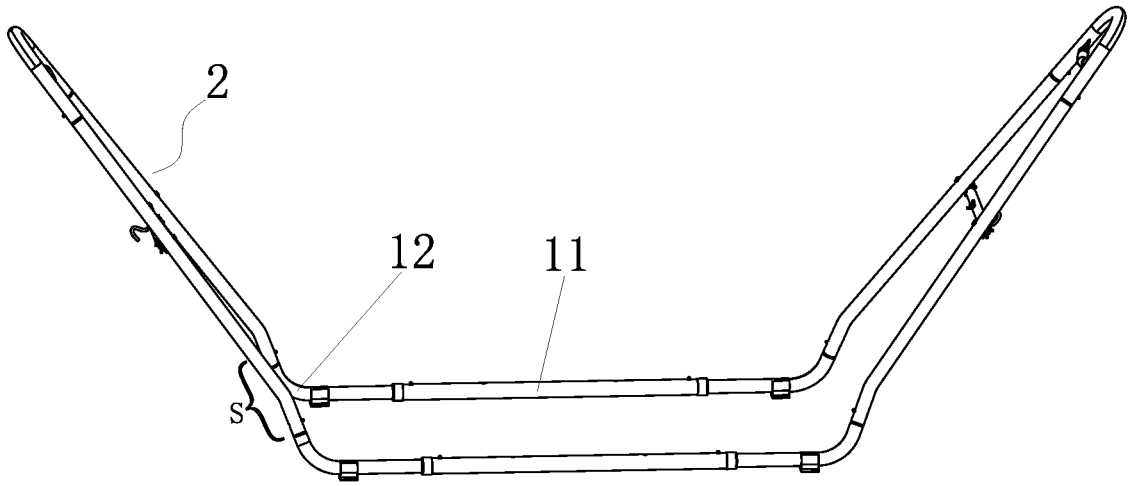
FIG. 11 schematically shows a spatial structure of a stand according to Embodiment 4 of this disclosure when used for suspending a hammock.
Figure 12:
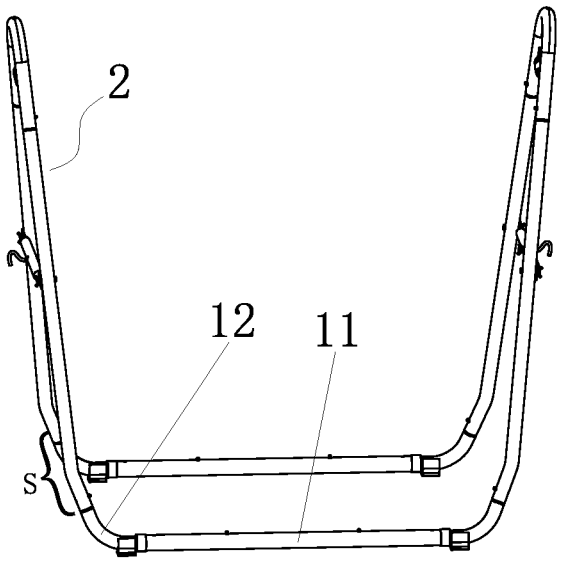
FIG. 12 schematically shows a spatial structure of the stand according to Embodiment 4 of this disclosure when used for suspending a hammock chair.
Figure 13:
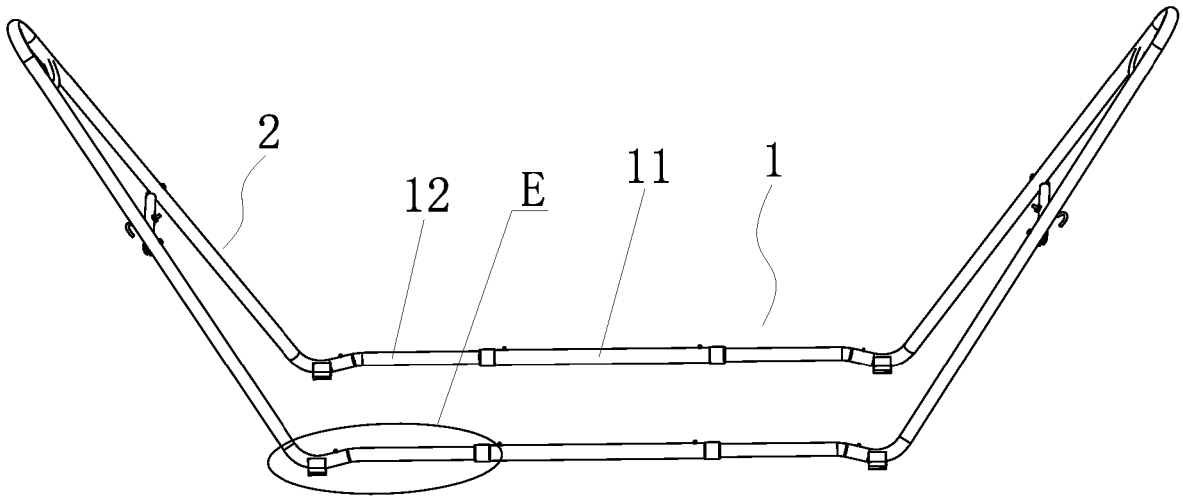
FIG. 13 schematically shows a spatial structure of a stand according to Embodiment 5 of this disclosure when used for suspending a hammock.

Referring to FIGS. 11 and 12, a dual-purpose stand provided in Embodiment 4 includes two support assemblies. The two support assemblies are configured to support each other to form a stable structure. The bending portion (S) is provided at a lower part of the suspension frame 2. The bottom rod 1 includes a base rod 11. Two ends of the base rod 11 are each connected to a connecting part 12. The connecting part 12 is in extendable-retractable fit with the base rod 11. The lower part of the suspension frame 2 is connected to the connecting part 12. Upper parts of suspension frames 2 are connected to each other at the same side to form an A-shaped structure.

The lower part of the suspension frame 2 is connected to the connecting part 12, and the upper parts of suspension frames 2 are connected to each other at the same side. The bottom rods 1 are arranged in parallel. Each part is connected to form an end-to-end circular structure, so as to form the stable structure to allow the stand to be placed stably. The transformation of the hammock suspension form and the hammock chair suspension form of the stand is easily realized through switching the installation mode of the suspension frame 2.

Embodiment 5

Referring to FIGS. 13-16, a dual-purpose stand provided in Embodiment 5 is basically the same as the dual-purpose stand provided in Embodiment 4, except that the bottom rod 1 includes a base rod 11. Two ends of the base rod 11 are each connected to a connecting part 12. The bending portion (S) is provided on the connecting part 12. The connecting part 12 is in extendable-retractable fit with the base rod 11. The lower part of the suspension frame 2 is connected to the connecting part 12, and upper parts of suspension frames 2 are connected to each other at the same side. In this embodiment, the bending portion (S) is provided on the bottom rod 1.

Figure 14:
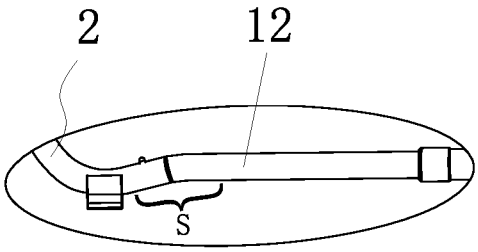
FIG. 14 is an enlarged view of part E in FIG. 13.
Figure 15:
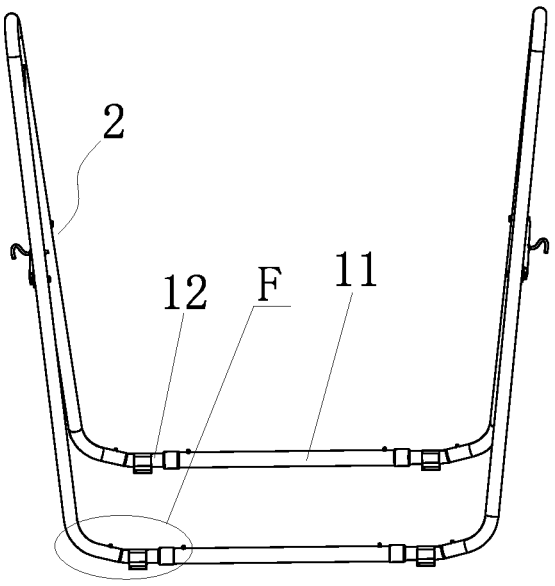
FIG. 15 schematically shows a spatial structure of the stand according to Embodiment 5 of this disclosure when used for suspending a hammock chair.
Figure 16:
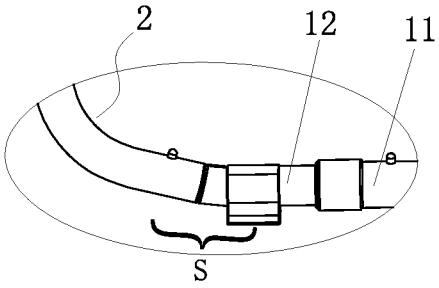
FIG. 16 is an enlarged view of part F in FIG. 15.

The transformation of the hammock suspension form and the hammock chair suspension form of the chair can be easily realized by switching the installation mode of the component (i.e., the connecting part 12) where the bending portion (S) is located. As shown in FIG. 14, in the hammock suspension form, an outer portion of the connecting part 12 is inclined downward. As shown in FIG. 16, in the hammock chair suspension form, the outer portion of the connecting part 12 is inclined upward.

Embodiment 6

Figure 17:
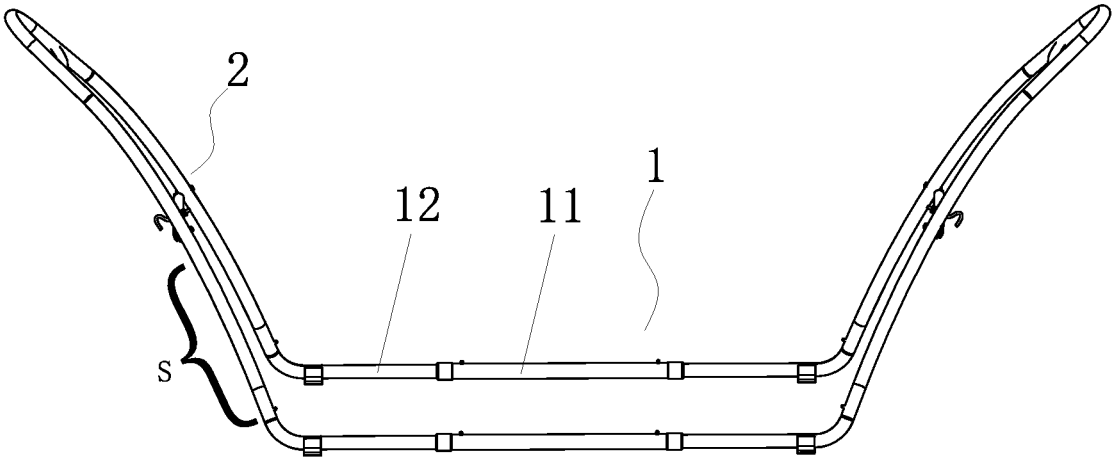
FIG. 17 schematically shows a spatial structure of a stand according to Embodiment 6 of this disclosure when used for suspending a hammock.
Figure 18:
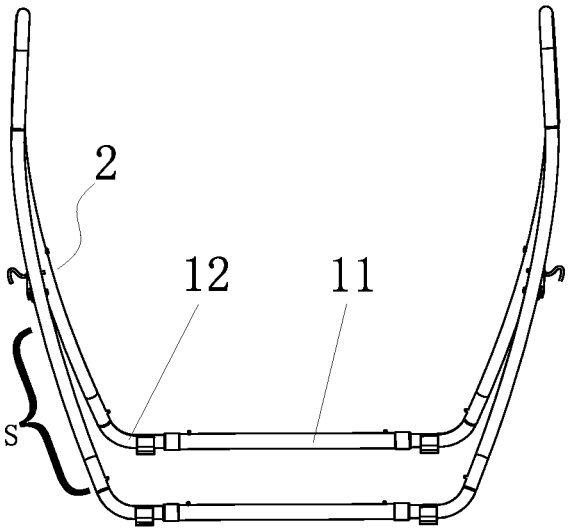
FIG. 18 schematically shows a spatial structure of the stand according to Embodiment 6 of this disclosure when used for suspending a hammock chair.

Referring to FIGS. 17-18, a dual-purpose stand provided in Embodiment 6 is basically the same as the dual-purpose stand provided in Embodiment 4, except that the suspension frame 2 has an arc structure. The bending portion (S) is provided at a lower part of the suspension frame 2, and the suspension frame 2 has an integrated structure. A connection portion where the bending portion (S) is connected to the bottom rod 1 still has a straight tube structure, and an upper part of the bending portion (S) is bent. The transformation of the hammock suspension form and the hammock chair suspension form can be easily realized through switching the installation mode of the suspension frame 2.

Embodiment 7

Figure 19:
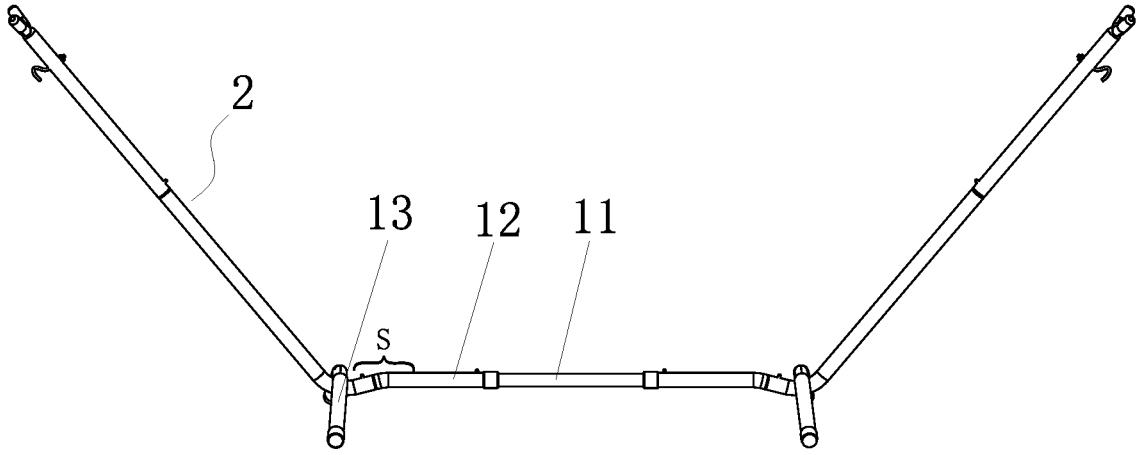
FIG. 19 schematically shows a spatial structure of a stand according to Embodiment 7 of this disclosure when used for suspending a hammock.
Figure 20:
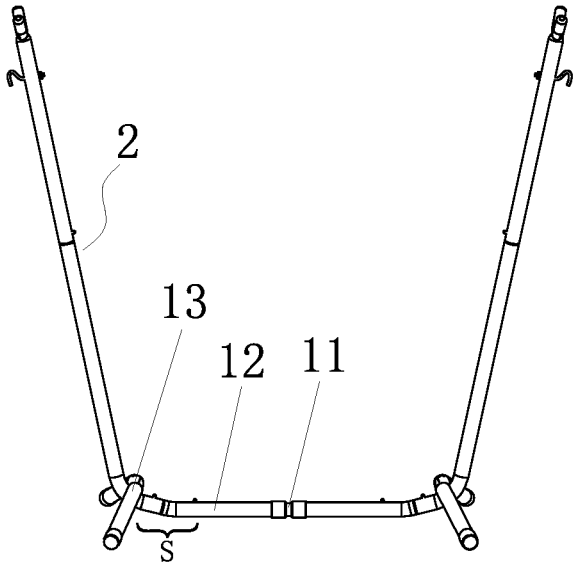
FIG. 20 schematically shows a spatial structure of the stand according to Embodiment 7 of this disclosure when used for suspending a hammock chair.

Referring to FIGS. 19-20, a dual-purpose stand provided in Embodiment 7 is basically the same as the dual-purpose stand provided in Embodiment 2, except that the bottom rod 1 includes a base rod 11. Two ends of the base rod 11 are each connected to a connecting part 12. The bending portion (S) is provided on the connecting part 12. The connecting part 12 is in extendable-retractable fit with the base rod 11. A bottom of the suspension frame 2 is provided with a base 13.

Embodiment 8

Figure 21:
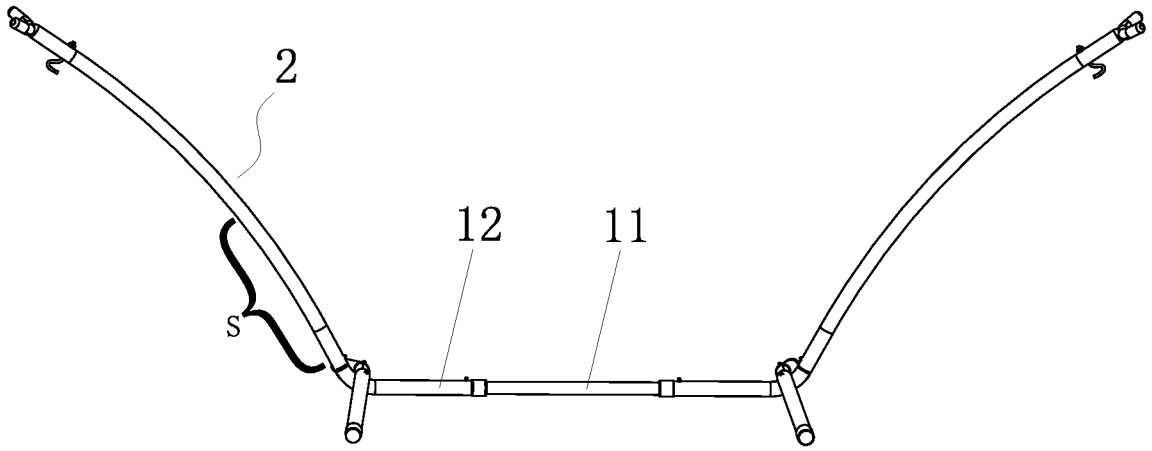
FIG. 21 schematically shows a spatial structure of a stand according to Embodiment 8 of this disclosure when used for suspending a hammock.
Figure 22:
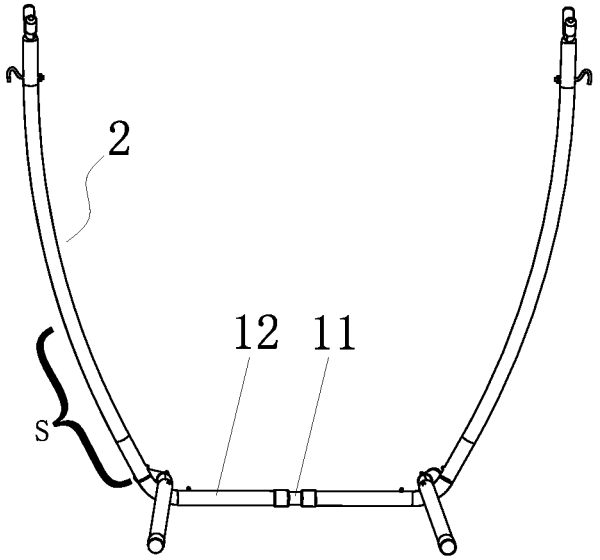
FIG. 22 schematically shows a spatial structure of the stand according to Embodiment 8 of this disclosure when used for suspending a hammock chair.

Referring to FIGS. 21-22, a dual-purpose stand provided in Embodiment 8 is basically the same as the dual-purpose stand provided in Embodiment 2, except that the suspension frame 2 has an arc and integrated structure.

Embodiment 9

Figure 23:
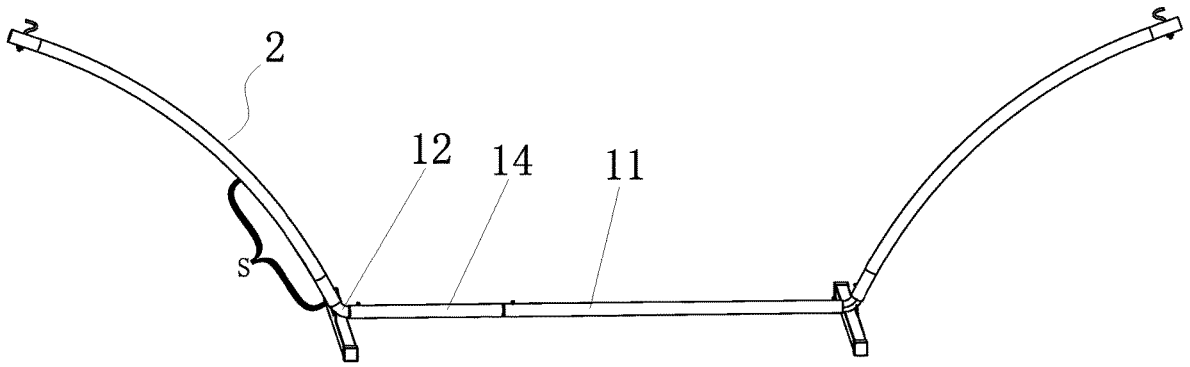
FIG. 23 schematically shows a spatial structure of a stand according to Embodiment 9 of this disclosure when used for suspending a hammock.
Figure 24:
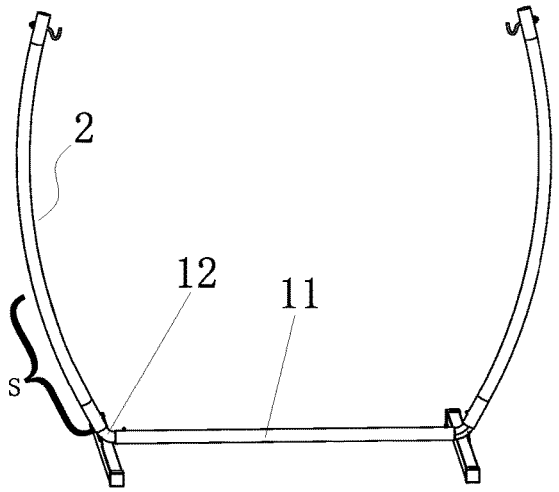
FIG. 24 schematically shows a spatial structure of a stand according to Embodiment 9 of this disclosure when used for suspending a hammock chair.

Referring to FIGS. 23-24, a dual-purpose stand provided in Embodiment 9 is basically the same as the dual-purpose stand provided in Embodiment 3, except that the suspension frame 2 has an arc and integrated structure.

Embodiment 10

Figure 25:
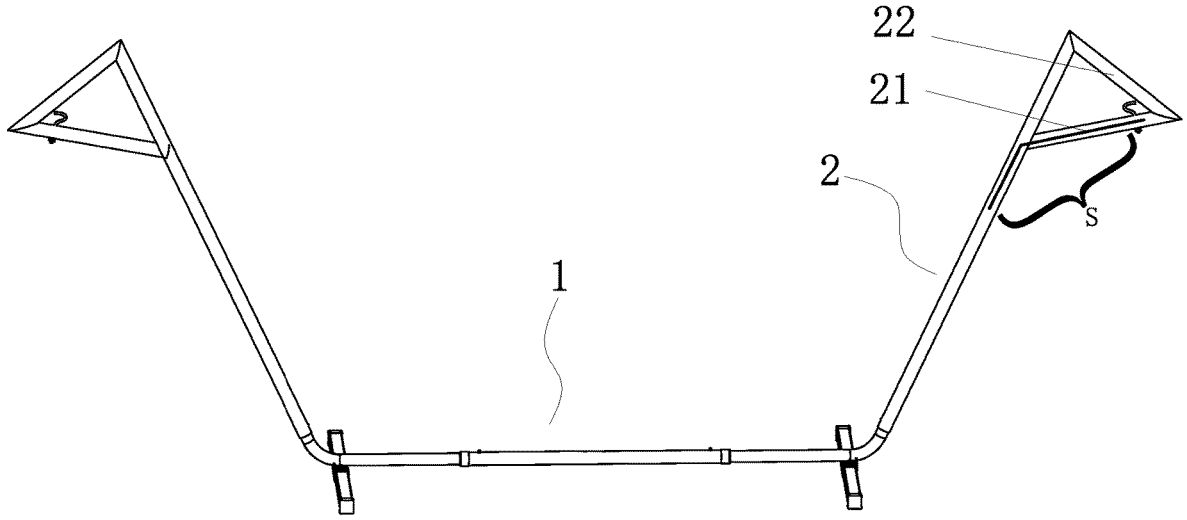
FIG. 25 schematically shows a spatial structure of a stand according to Embodiment 10 of this disclosure when used for suspending a hammock.
Figure 26:
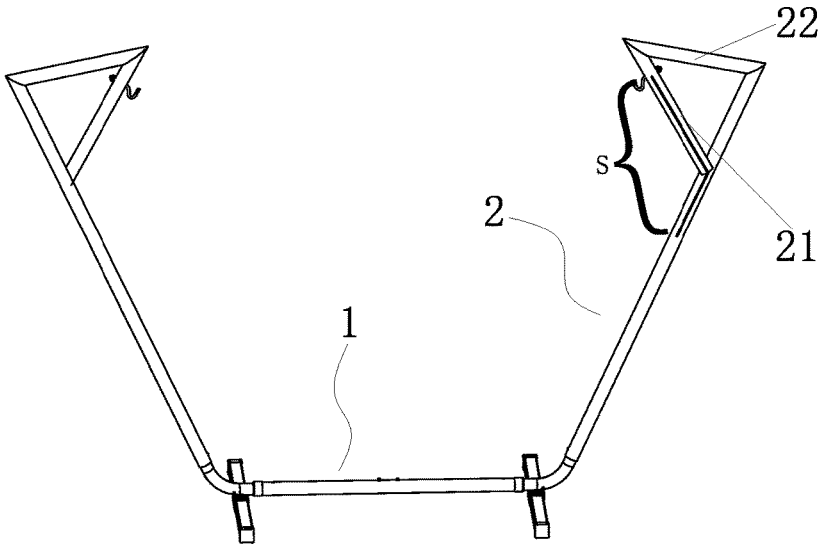
FIG. 26 schematically shows a spatial structure of the stand according to Embodiment 10 of this disclosure when used for suspending a hammock chair.

Referring to FIGS. 25-26, a dual-purpose stand provided in Embodiment 10 includes one support assembly. The support assembly includes a bottom rod 1. Two ends of the bottom rod 1 are each provided with a suspension frame 2. An upper part of the suspension frame 2 is provided with a second support rod 21 to allow the suspension point deviate from the axis of the suspension frame 2. A fixed rod 22 is provided between the suspension frame 2 and the second support rod 21 to form a triangular structure to improve the strength of the second support rod 21. In this embodiment, the bending structure formed by the second support rod 21 and the suspension frame 2 is the bending portion (S) (shown by the thick solid line in FIGS. 25-26). As shown in FIG. 25, when the hammock is suspended, the second support rod 21 faces outward, that is, the suspension point is on an outer side of the suspension frame 2. As shown in FIG. 26, after turning the suspension frame 2 180°, when the hammock is suspended, the second support rod 21 faces inward, that is, the suspension point is on an inner side of the suspension frame 2. In this embodiment, the second support rod 21 can be replaced by other structures to meet the requirement that the suspension point deviates from the axis of the suspension frame 2, and the corresponding part of the extension structure and the suspension frame 2 is configured to form the bending portion (S).

Described above are merely illustrative of this application, and are not intended to limit this application. The functions and structural principles of this application have been illustrated and described above with reference to the embodiments. It should be understood that various modifications and changes made by those skilled in the art without departing from the spirit and scope of this application shall fall within the scope of this application defined by the appended claims.

What is claimed is:

1. A dual-purpose stand for a hammock and hammock chair, comprising: at least one support assembly; wherein the at least one support assembly each comprises a bottom rod; two ends of the bottom rod are each provided with a suspension frame; and the suspension frame is fixedly connected to the bottom rod by an insertion pin and a pin hole; and the at least one support assembly is each provided with a bending portion; the bending portion has an obtuse-angle structure with a fixed angle; and the bending portion is configured to transform between a hammock suspension form in which the suspension frame is extended outward using the obtuse-angle structure and a hammock chair suspension form in which the suspension frame is retracted inward using the obtuse-angle structure; and an azimuth difference when turning the bending portion between the hammock suspension form and the hammock chair suspension form is 180°.

2. The dual-purpose stand of claim 1, wherein the bending portion is provided on the suspension frame.

3. The dual-purpose stand of claim 2, wherein the number of the at least one support assembly is one; the bottom rod comprises a base rod and connecting parts respectively connected to two ends of the base rod; and each of the connecting parts is provided with a base; and the connecting parts are in extendable-retractable fit with the base rod.

4. The dual-purpose stand of claim 2, wherein the number of the at least one support assembly is one; the bottom rod comprises a base rod, an extension rod and two connecting parts; the base rod is in detachable fit with the extension rod; the two connecting parts are connected to the base rod or the extension rod; and the two connecting parts are each fixedly provided with a base.

5. The dual-purpose stand of claim 2, wherein the number of the at least one support assembly is two; two support assemblies are configured to support each other to form a stable structure; the bottom rod comprises a base rod; two ends of the base rod are each connected to a connecting part; the connecting part is in extendable-retractable fit with the base rod; a lower part of the suspension frame is connected to the connecting part; and upper parts of suspension frames are connected to each other at the same side.

6. The dual-purpose stand of claim 1, wherein the suspension frame has an arc structure.

7. The dual-purpose stand of claim 1, wherein the two ends of the bottom rod are each provided with the bending portion.

8. The dual-purpose stand of claim 7, wherein the number of the at least one support assembly is one; the bottom rod comprises a base rod; two ends of the base rod are each connected to a connecting part; the bending portion is provided on the connecting part; the connecting part is in extendable-retractable fit with the base rod; and a bottom of the suspension frame is provided with a base.

9. The dual-purpose stand of claim 7, wherein the number of the at least one support assembly is two; two support assemblies are configured to support each other to form a stable structure; the bottom rod comprises a base rod; two ends of the base rod are each connected to a connecting part; the bending portion is provided on the connecting part; the connecting part is in extendable-retractable fit with the base rod; a lower part of the suspension frame is connected to the connecting part; and upper parts of suspension frames are connected to each other at the same side.

10. The dual-purpose stand of claim 1, wherein each connection on the dual-purpose stand is in plug-in fit.

* * * * *